United States Patent [19]

Koine

[11] 4,392,414

[45] Jul. 12, 1983

[54] AMMUNITION BELT

[75] Inventor: Richard Koine, Ratingen, Fed. Rep. of Germany

[73] Assignee: Rheinmetall GmbH, Duesseldorf, Fed. Rep. of Germany

[21] Appl. No.: 231,410

[22] Filed: Feb. 4, 1981

[30] Foreign Application Priority Data

Feb. 13, 1980 [DE] Fed. Rep. of Germany ..... 3005256

[51] Int. Cl.[3] ..... F42B 39/08

[52] U.S. Cl. ..... 89/35 R

[58] Field of Search ..... 89/33 BB, 33 BC, 33 C, 89/33 CA, 35 R

[56] References Cited

U.S. PATENT DOCUMENTS

| | | | |
|---|---|---|---|
| 1,357,513 | 11/1920 | Pettys | 89/35 R |
| 2,830,351 | 4/1958 | Harding et al. | 89/33 BB |
| 3,706,260 | 12/1972 | Rausing | 89/35 R |
| 4,114,511 | 9/1978 | Patenaude | 89/35 R |

FOREIGN PATENT DOCUMENTS

| | | | |
|---|---|---|---|
| 513452 | 8/1952 | Belgium | 89/35 R |
| 2012379 | 9/1970 | Fed. Rep. of Germany . | |

*Primary Examiner*—Stephen C. Bentley

[57] ABSTRACT

An improved ammunition belt for automatic barrel weapons such as machine cannons. The ammunition belt is composed of a plurality of belt members each of which is adapted to accommodate and resiliently hold an ammunition unit in operative position therein. The belt members include pin-like projections which are adapted to interact with the gear-teeth or the like of an ammunition unit thereon and includes a pair of straps connected to the belt member by means of a first pivotal connection. The members for detachably holding the ammunition units as well as the first pivotal connection have the pin-like projections which are adapted to interact with the belt feed mechanism. The straps have arcuate slits spaced from the axis of the first pivotal connection. Pin-like projections secured to the projections of the belt members extend through the arcuate slits to form second pivotal connections. The projections of each belt member may be resiliently movably mounted relative to each other so that, when being moved towards each other, the respective first pivotal connection is detached.

2 Claims, 3 Drawing Figures

AMMUNITION BELT

BACKGROUND OF THE INVENTION

The invention relates to an ammunition belt of the type disclosed and described in German published unexamined application DE-OS No. 20 12 379. Such an ammunition belt consists of a relatively stiff band of thermoplastic material, in which there are disposed uniformly spaced recesses for receiving ammunition units therein. By means of weakening the region between adjacent recesses, the belt can be bent without being permanently deformed. Each ammunition unit is fixedly held on the belt in adjacent recesses by means of a thin film strip which is welded to the belt in the region between adjacent recesses. In at least one longitudinally extending border region the belt has a plurality of equidistantly disposed perforations which serve to permit a coaction with a mechanism for transporting the ammunition belt through the weapon. In order to remove the ammunition unit from its recess the thin film is cut by means of an arrangement disposed at the inlet side of a belt guide in the weapon. A belt of this type is particularly suitable for ammunition units without cartridge casings, which, as a result of their reduced mechanical strength, tend to be fractured or damaged. It has been found to be disadvantageous that the afore-described ammunition belt cannot be reused and therefore cannot be operated as an endless belt, which can, while being operated, be resupplied with ammunition units.

SUMMARY OF THE INVENTION

The invention has as a general object to provide an ammunition belt of the afore-described type in which the afore-described drawback has been eliminated.

BRIEF DESCRIPTION OF THE DRAWINGS

The above object, features and advantage of the instant invention along with other objects, features and advantages will become apparent upon reading of the following description of two preferred embodiments of the instant invention in conjunction with the drawings as follows.

DETAILED DESCRIPTION

Figure 1:
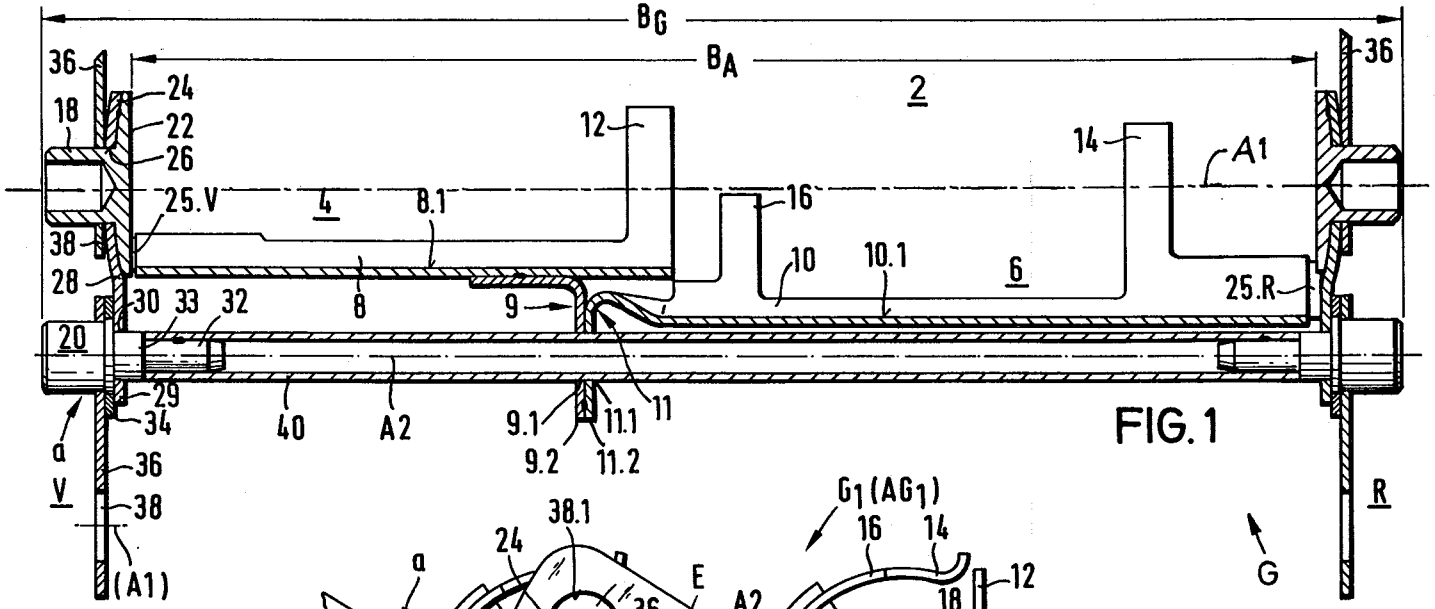
FIG. 1 is a longitudinal sectional view of a first belt member in accordance with the invention.

A first belt member G has on its upper surface a recess 2 to receive a non-illustrated ammunition unit. The recess 2 consists of a front part 4 and a rear part 6 and has a central longitudinal axis A1. The front part 4 has a front-facing outer border region V and the rear part 6 has a rear-facing outer border region R. A flat channel 8 extends through the forward part 4 and is formed at its rear as a holding clamp 12. A flat channel 10 extends through the rear part 6 and is provided with a holding clamp 14 and an upwardly bent portion 16. The recess 2 has a length $B_A$ which is determined by a forward and rear side at which respectively the end elements 22 are mounted. Each end element 22 has a projecting pin 18 extending therefrom. The end element 22 is firmly connected to an outer sheet metal sheeting

24, through the bore 26 of which the pins 18 extend. The sheeting 24 has at its underside a middle tongue 28 having a free end 29 in which an eye 30 is disposed. At both sides of the tongue 28 the outer sheeting 24 is continued in the front-facing outer border region V (the rear-facing outer border region R) with two perpendicularly bent strips 25.V(25.R), which are on the bottom exteriorly fixedly connected to the channel 8 (10). In the vicinity of the middle region of the recess 2 there is secured to the underside of the channel 8 an angular stop 9 having a bore 9.1. In this region of the recess 2 the flat channel 10 has a downwardly bent sheet metal strip 11 with a bore 11.1. The free ends 9.2 and 11.2 of the parts 9 and 11 are firmly secured to each other, whereby the bores 9.1 and 11.1 coincide with each other. In this manner the channels 8 and 10 are sufficiently torsion-resistantly secured to each other. As can be noted, the upper side 10.1 of the channel 10 is disposed at a greater distance from the longitudinal axis A1 than the upper side 8.1 of the channel 8. In this manner the overall configuration of the recess 2 is adapted to mate with the ammunition unit, the propellant charge of which has, in the vicinity of the rear-facing outer border region R, a larger diameter than the projectile, the nose of which adjoins the front-facing outer border region V. The length $B_A$ of the recess 2 is adapted to the length $l_M$ of the ammunition unit, so that the length $B_A$ is at least equal to the length $l_M$, preferable however slightly larger than it. A connecting cylinder 40 extends along a central longitudinal axis $A_2$, which is parallel to the central longitudinal axis $A_1$ of the recess 2, at a predetermined distance from the undersides of the channels 8 and 10. The openings at the opposite ends of the cylinder 40 serve for firmly mounting therein a corresponding centering pin 32. A bearing boss 33 extends from the pin 32 and ends in a projecting pin 20. The connecting cylinder 40 freely extends through the openings 9.1 and 11.1, whereas the bearing bosses 33 extend freely through the eyes 30 to form a pivot connection a. In the immediate vicinity of the outer side of the middle tongue 28 in the region of its eye 30 the projecting pin 20 is connected with a spacer sheet metal plate 34, on opposite sides of the outer surface of which a strap 36 is fixedly secured. This strap has an arcuate slit 38 divided by a middle arcuate line 38.3, the curvature middle point of which is aligned with the axis A2 of the pivot connection a. The width of the circular arcuate slit 38 corresponds essentially to a not further described diameter of the pin 18. As can be noted from FIG. 3, the circular arcuate slit 38 of the belt member $G_1(AG_1)$ serves to provide a pivotal connection with an adjoining belt member $G_2$ and so on. In this manner a belt of any selected length, even an endless belt, can be manufactured, which after its emptying can again be armed with ammunition units.

An ammunition belt of the afore-described type cannot be detached. To obtain a detachable feature of a corresponding belt, a modified second embodiment of the ammunition belt $AG_1$ is hereinafter described. Particular attention is drawn to the region L in FIG. 2, wherein the ammunition belt member $AG_1$ corresponds in numerous individual features with the afore-described belt member G, and a repeated description of these corresponding features is hereinafter omitted. A downwardly bent sheet metal strip 11' at the channel 10 has underneath a bore 11.1' in a normally extending portion 11.2' thereof, which continues by way of a portion 11.3' extending parallel to the connecting cylinder 40' and thereafter is followed by a further normally upwardly extending portion 11.5', which extends perpendicular to the channel 8 and ends in a free end 11.7' and has a bore 11.6'. A slit 11.4' is disposed in the part 11.3' and has a predetermined length b'. An angular stop 9' is affixed to the underside of channel 8 and has a bore 9.1' and the free end 9.2' thereof extends through the slit 11.4'. The connecting cylinder 40 extends through the bores 9.1', 11.6' and 11.1'. In the region between the portion 11.5' and the middle tongue 28.1 a coil spring 42 encompasses the connecting cylinder 40 (in the vicinity of the front-facing outer border region V). The coil spring 42 abuts with one of its ends against the inner side 28.1 of the middle tongue 28 and with its other side against the confronting face 11.8' of the free end 11.7'. By means of the afore-described arrangement an axial, slidability of both channels 8 and 10 as well as the pins 18 relative to each other is obtained while simultaneously a mutual torsional stiffness of both channels 8 and 10 is obtained. The degree of an axial slidable adjustment is determined by the length b' of the slit 11.4'. b' corresponds at least to two times the length b/2 of the pin 18. As soon as an ammunition unit has been removed from the ammunition belt by axially sliding the pin 18 toward each other and away from the straps 36 of the preceding belt member the total length $B_G$ of the belt member AG is reduced by the distance 2b/2. By means of the previously mentioned arrangement disposed at the side of the weapon (generally a belt guide) the parts 12 and 16 can, for example, (and thereby also the pins 18) due to corresponding progressive actuation on the therefrom facing-away faces 12.1 and 16.1, be moved toward each other against the force of the coil spring 42 to thereby release the belt member $AG_1$ from the adjoining belt member. After the detachment of the corresponding belt member and the ejection of the member $AG_1$ the latter is again returned to a condition in which it assumes the total length $B_G$ and can be again utilized. Depending on the arrangement of the respective belt member AG (either with or without intermediately linked belt members G) a detachability of the belt in accordance with the invention can be predetermined and be adapted to the operative requirements of the weapon. As can be noted from FIGS. 2 and 3, the pins 18 and 20 are at all times arranged in pairs on the axes A1, respectively A2. They form therefore in a simple manner the mating engaging means for a conventional roller bevel gear wheel of a belt feed guide.

Figure 3:
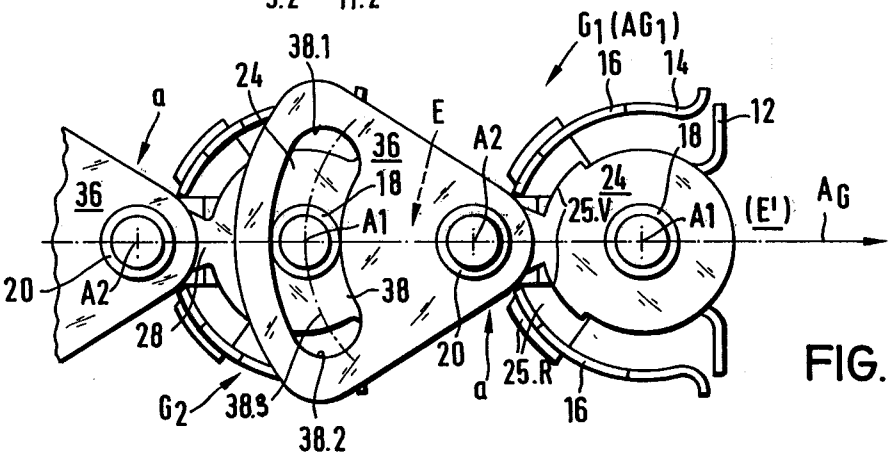
FIG. 3 is a side-elevational view of the ammunition belt illustrated in FIG. 2 along line III—III of FIG. 2.
Figure 2:
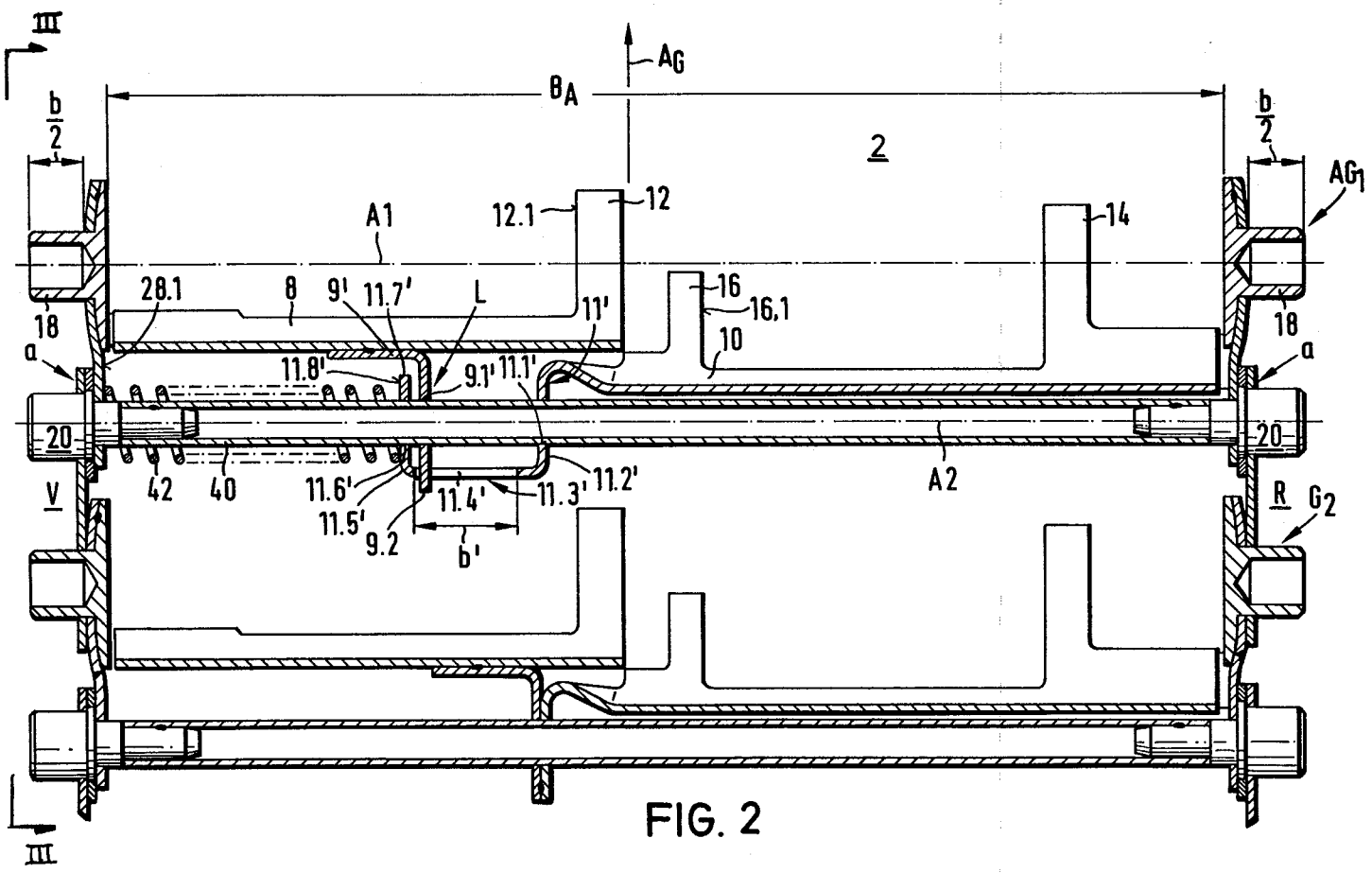
FIG. 2 is a longitudinal sectional view of a portion of the belt having a first belt member in accordance with FIG. 1 and a second modified belt member pivotally connected thereto.

As can be noted from FIG. 3, the belt in accordance with the invention can be rolled about its longitudinal axis $A_G$ upwardly or downwardly as viewed in FIG. 2. This feature is obtained by way of the configuration of the opening 38 which is in the form of a circular arcuate slit having opposite end regions 38.1 and 38.2. The construction ensures that the linear distance between the pins 18 and 20 remains constant in the front-rear-facing outer border regions V, R, said distance being determined by a line following an arcuate path.

A further advantage of the ammunition belt in accordance with the invention results from the secure mounting of the ammunition units in the recesses 2. This is achieved not only by the peripherally acting holding forces by the action of the holding clamps 12 and 14, but in particular also due to the arrangement of the free ends 9.2 and 11.2 in a belt member G or the arrangement of the free ends 9.2' and a belt member AG. The aforementioned free ends insure that in the region E (see FIG. 3) the immediately adjacent ammunition unit is secured against falling out from the recess 2. Only when a mutual pivoting is carried out, which corresponds to a belt bending arc having a predetermined radius of curvature, the ammunition units can be removed from the recess 2 or inserted into the recess 2. A clamping action by the holding clamps 12, 14 needs advantageously only be carried out to such an extent that with an end belt member having a region E', the ammunition unit does not fall out of the recess 2 even when the corresponding belt member is hanging down.

The winding of the ammunition belt about its longitudinal axis $A_G$ is required to compensate the elevation, when the weapon is provided with an ammunition storage device secured above the gun carriage. When an ammunition storage device is non-rockably arranged and thus follows the elevational movement of the gun barrel, the ability to wind the belt can be dispensed with. In such a case the opening 38 in the strap 36 can only consist of a pivotal opening, the cross section of which corresponds substantially to the peripheral cross section of the pin 18. By means of one or the other arrangement of the ammunition storage device arrangement adjoining the weapon, the possible size of the storage device is, however, predetermined to a great extent; thus a storage device fixedly secured above the gun carriage can obviously be of a larger size than a non-rockably mounted storage device.

The ammunition belt in accordance with the invention can advantageously be made predominantly out of synthetic material. Thus, the joining of the individual parts can be carried out by means of a welding process as well as by glueing.

Although the invention is illustrated and described with reference to a plurality of embodiments thereof, it is to be expressly understood that it is in no way limited to the disclosure of such preferred embodiments, but is capable of numerous modifications within the scope of the appended claims.

I claim:

1. An improved ammunition belt for automatic barrel weapons, in particular machine cannons, wherein the belt comprises a plurality of belt members each of which is adapted to accommodate an ammunition unit therein and which includes flexible retention means mounted on the belt for maintaining the ammunition units in operative position thereon and which includes means for interaction with the ammunition belt feed means of the automatic barrel weapon, the improvement comprising (a) each belt member comprises ammunition holding means for detachably holding an ammunition unit in operative position in said belt member; and at least one strap pivotally connected to the ammunition holding means by means of a first pivotal connection;

(b) each of said straps having an opening passing therethrough which is spaced from the first pivotal connection between said strap and said holding means;

(c) the means for interaction with the ammunition belt feed means being disposed on said ammunition holding means and at the first pivotal connection connecting the holding means and the strap;

(d) the opening in said strap is adapted to form part of a second pivotal connection connecting said strap and the ammunition holding means of the next following belt member, said second pivotal connection also forming part of said means for interaction with the ammunition belt feed means;

(e) a pair of straps is pivotally connected to opposite ends of said ammunition holding means to form said first pivotal connection; said means for interaction with the ammunition belt feed means being formed by pin-like projections at said second pivotal connection on said holding means and said first pivotal connection; and (f) said opening has an arcuate configuration the center of curvature of which coincides with the axis of the first pivotal connection.

2. The improvement in an improved ammunition belt for automatic barrel weapons as set forth in claim 1, wherein said ammunition holding means are formed of two parts which are resiliently movably mounted relative to each other, each part being fixedly secured to a pin-like projection, and means for detaching said belt at the first pivotal connection by moving said two parts towards each other; and including means in said two parts forming said ammunition holding means respectively biasing them toward said first and second pivotal connections.

* * * * *